United States Patent [19]

Whipps

[11] 4,028,896

[45] June 14, 1977

[54] SLUICE GATE ASSEMBLY

[75] Inventor: George E. Whipps, Athol, Mass.

[73] Assignee: Rodney Hunt Company, Orange, Mass.

[22] Filed: Mar. 4, 1976

[21] Appl. No.: 663,842

[52] U.S. Cl. ..... 61/28; 251/203

[51] Int. Cl.[2] ..... E02B 7/28

[58] Field of Search ..... 61/28, 29, 22 R, 22 A; 251/203

[56] References Cited

UNITED STATES PATENTS

| | | | |
|---|---|---|---|
| 550,711 | 12/1895 | Eads | 251/203 |
| 2,236,352 | 3/1941 | McCarthy | 251/203 |
| 2,889,684 | 6/1959 | Abrahams | 61/22 A |
| 3,333,814 | 8/1967 | Sargent | 251/203 |
| 3,401,527 | 9/1968 | Palmer et al. | 61/28 |
| 3,760,593 | 9/1973 | Whipps | 61/28 |

FOREIGN PATENTS OR APPLICATIONS

| | | | |
|---|---|---|---|
| 2,128,402 | 12/1972 | Germany | 61/28 |

*Primary Examiner*—Paul R. Gilliam
*Assistant Examiner*—Alex Grosz
*Attorney, Agent, or Firm*—Thompson, Birch, Gauthier & Samuels

[57] ABSTRACT

A sluice gate assembly is disclosed which includes a single-flange cast frame, a pair of elongated grooved gate disc guides mounted on the frame, a gate disc slidably supported by the grooved gate disc guides for vertical movement between a raised open position and a lowered closed position, and a wedge system for wedging the gate disc into sealing engagement against the frame when the gate disc is in its lowered closed position.

5 Claims, 4 Drawing Figures

14
14a
16'
106
10
18c
98
24
80
58
43
64
60
84
18a
76c
90
92
50
52
74
78
3
18b
76b
22
102
96
42
20

SLUICE GATE ASSEMBLY

DESCRIPTION OF THE INVENTION

This invention relates generally to devices for controlling the flow of liquids, and is concerned in particular with the provision of a new and improved sluice gate assembly.

The invention is directed to sluice gate assemblies of the type which include a frame having gate disc guides mounted thereon, a gate disc movable vertically between the gate disc guides between open and closed positions, and associated wedge components for wedging the gate disc into sealing engagement with the frame when the gate disc is closed. The frame is adapted to be bolted to a support surface, for example a pipe flange, wall casting or thimble embedded in a concrete wall, or in some instances directly to the concrete wall itself.

Known sluice gate assemblies of the above-described type generally have one or more disadvantageous features associated therewith. For example, most known sluice gate assemblies have frames which are of two basic types, namely double-flange and single-flange, the latter also being referred to as "flat " frames. Double-flange frames have spaced front and back flanges which are joined along the inside edges by an intermediate web, thereby providing a generally C-shaped cross-section. The back flange is used to mount the gate assembly on a support surface of the type described above, and the front flange provides a mounting surface for the gate disc guides. With a flat frame, only one flange is employed.

Double-flange frames require more casting metal than flat frames, thus making them more expensive to fabricate. Moreover, the C-shaped cross-sections of double-flange frames require core-type casting molds, where normally the frame flanges must be tapered with opposed non-parallel surfaces. This in turn complicates subsequent machining of finished surfaces, particularly the spot facing of bores. Also, double-flange frames are more difficult to mount where lateral installation clearances are minimal, making it necessary for construction personnel to reach around the front flange in order to gain access to the mounting bolts extending through the back flange. These drawbacks are not present with flat frames. However, double-flange frames are preferred over flat frames by architects and engineers because of the belief that double-flange frames offer more strength and rigidity.

Other known sluice gate assemblies incorporate somewhat improved single-flange frames with L-shaped cross-sections defined by an inner wall and a single rear flange, the rear flange being coplanar and adapted to be bolted to the mounting surface, and the inner wall of the frame cooperating with mating grooves on the disc guides to guide the gate disc in its vertical movement between open and closed positions. Because the gate frame and disc guides are cooperatively grooved to guide the gate disc, this arrangement requires vertical side extensions on the frame well above the frame opening, a feature which is of course expensive not only from the standpoint of material employed, but also from the standpoint of machining operations required during fabrication.

An object of the present invention is the provision of a sluice gate assembly embodying an improved single-flange frame which incorporates all of the advantages of conventional frames, without any of the disadvantages or drawbacks commonly associated therewith.

A more specific object of the present invention is the provision of an improved sluice gate assembly embodying a single-flange frame with an L-shaped cross-section which is not in cooperative relationship with grooves on the gate disc guides.

Another object of the present invention is the provision of a novel and improved sluice gate assembly having a single flange frame with an L-shaped cross-section surrounding the frame opening, without extensions above the frame, and further including gate disc guides grooved to guide the gate disc in its vertical movement therebetween, the said grooves being formed independently of any surface or groove on the gate frame.

These, and other objects and advantages of the present invention will become more apparent as the description proceeds with the aid of the accompanying drawings, wherein.

Figure 1:
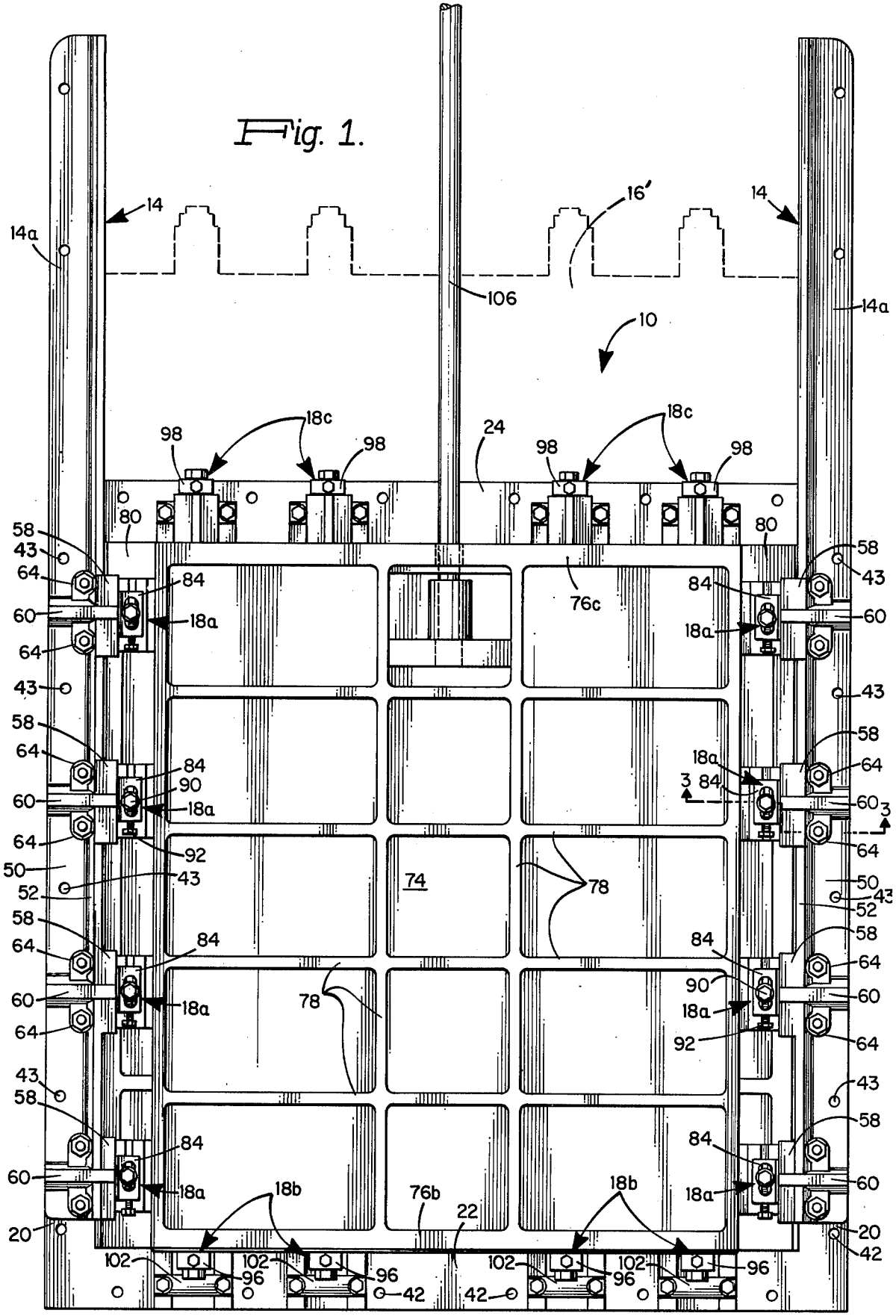
FIG. 1 is a front elevational view of a preferred embodiment of a sluice gate assembly embodying the concepts of the present invention.

Referring now to the drawings wherein like numbers designate like parts throughout the several views, there is shown at 10 a preferred embodiment of a sluice gate assembly in accordance with the present invention. The assembly is comprised of the following basic components: a frame 12; a pair of gate disc guides 14; a gate disc 16; and side, bottom and top wedge assemblies respectively indicated typically at 18*a*, 18*b* and 18*c*.

Figure 2:
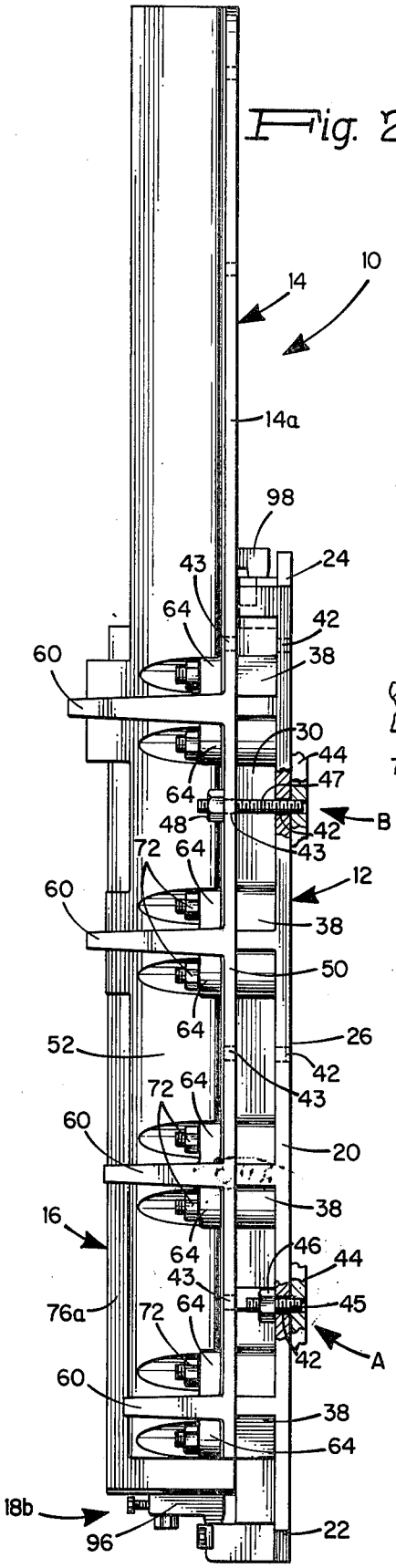
FIG. 2 is a side elevational view of the sluice gate assembly shown in FIG. 1.

The frame 12, which is integrally cast as a single unit, includes a single rear flange having vertically extending laterally spaced side flange sections 20 joined by horizontally extending top and bottom flange sections 22, 24. The side flange sections 20 and the bottom and top flange sections 22, 24 form a coplanar rear frame surface 26, as can be seen in FIG. 2. This feature adapts the frame for attachment to a flat mounting surface (not shown) such as for example that provided by pipe flanges, wall castings or thimbles, etc. The aforesaid flange sections define an opening 28, the size of which will vary depending on the size of the sluice gate assembly.

Figure 3:
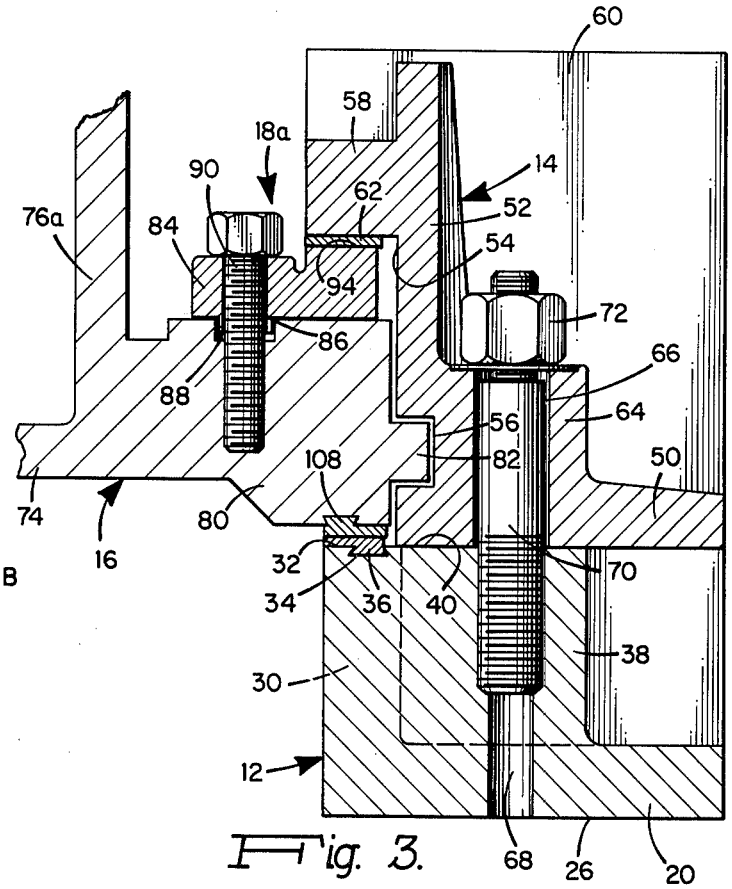
FIG. 3 is a sectional view on an enlarged scale taken along lines 3—3 of FIG. 1; and, FIG. 4 is an exploded perspective view of the sluice gate assembly shown in FIGS. 1 and 2.
Figure 4:
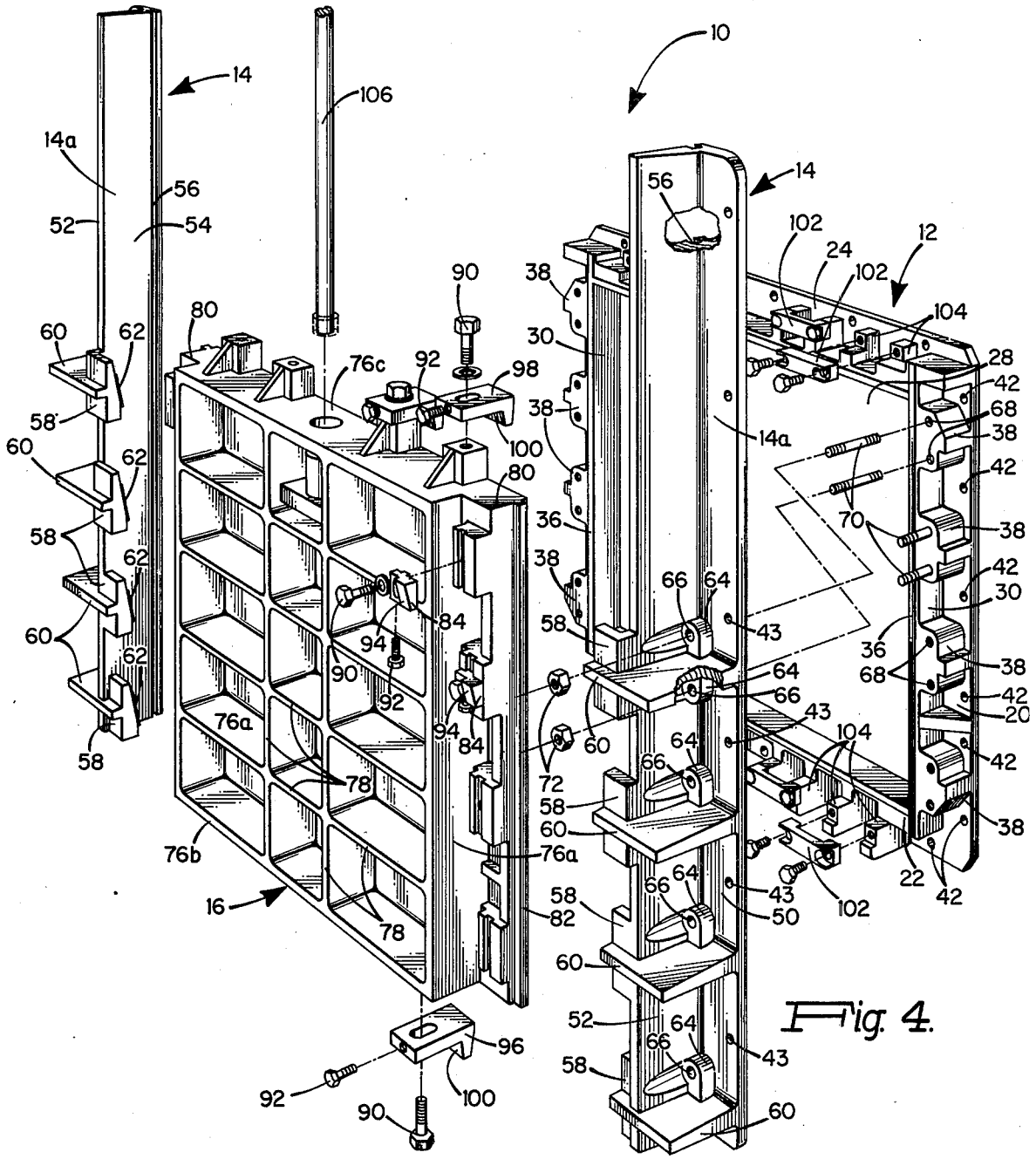

The side flange sections 20 have longitudinal inner walls 30 protruding vertically from the inner edges thereof. The top edges 32 of the inner walls 30 have dove-tailed grooves 34 adapted to receive bronze seat facings 36. The frame 12 is further provided with a plurality of vertically spaced bosses 38 at the juncture between the inner walls 30 and the side flange sections 20. As is best shown in FIG. 3, the top surfaces 40 of the bosses 38 are arranged in a common plane which is parallel to the plane containing the rear frame surface 26. The upper edges 32 of the inner walls 30 are coplanar with the upper surfaces 40 of the bosses 38, but slightly below the upper surfaces of the bronze seat facings 36. The flange sections 20, 22, 24 are appropriately drilled as indicated typically at 42 to accommodate mounting studs, as hereinafter described.

As is best shown in FIG. 3, the frame 12 is only grooved as at 34 to accept the bronze seat facings 36. No gate disc guide grooves are provided in the frame, and hence the frame need not embody vertical extensions.

The gate disc guides 14 each comprise longitudinal castings made up of a base flange 50 and a generally perpendicular guide flange 52 arranged to provide somewhat of an L-shaped cross-section. The holes 42 in the frame flange sections 20 are arranged to lie in registration with holes 43 drilled in the base flanges 50 of the guides 14. As is best shown in FIG. 2, this arrangement of the holes 42, 43 allows the sluice gate assembly to be mounted in one of two different ways. For example, and as shown at "A", where there is ample side clearance around the gate assembly, mounting on a gate thimble 44 or other equivalent support can be accomplished by relatively short thimble studs 45 bolted as at 46. However, as indicated at "B", where absence of side clearance does not afford workmen with the opportunity to insert a wrench between the frame flange sections 20 and the overlying base flanges 50 of the gate disc guides 14, then longer thimble studs 47 can be used to extend through aligned holes 42, 43 with nuts applied to the studs as at 48. Thus it will be seen that the gate assembly can be mounted with or without side clearance, the only modification being the use of different-length thimble studs 45, 47.

The inner surface 54 of guide flange 52 has a guide groove 56 cut therein, which preferably extends vertically along the entire length of the disc guide 14. Each disc guide 14 further includes a plurality of vertically spaced inwardly cantilevered wedge seats 58 reinforced by transverse flanges 60 which are integrally cast with the wedge seats 58, the guide flange 52 and the base flange 50. The undersides of the wedge seats 58 are inclined and faced with bronze strips 62. The base flanges 50 are provided on either side of the transverse flanges 60 with bosses indicated typically at 64 which are drilled as at 66. As shown in FIG. 3, the holes 66 are arranged for alignment with tapped holes 68 in the bosses 38 on the frame 12, the latter having studs 70 threaded therein. When the disc guides 14 are mounted on the frame 12, the studs 70 extend through the holes 66 in bosses 64, their exposed ends being threaded to receive conventional nuts 72. The upper sections **14*a* of the disc guides 14 extend vertically above the frame 12, as is best shown in FIGS. 1 and 2.**

The gate disc 16 has a heavy front plate 74 reinforced by side, bottom and top ribs **76*a*, 76*b* and 76*c* and intermediate webs indicated typically at 78, all cast into a single integral structure. Heavy flanges 80 extend laterally from the side ribs 76*a*. The edges 82 of flanges 80 are adapted to be received in sliding engagement in the guide grooves 56 of the gate disc guides 14.**

It will thus be understood that at all times during its vertical movement between raised open positions (one being indicated in dotted at 16' in FIG. 1) and a lowered closed position, the gate disc 16 will be guided by its edges 82 being in sliding engagement with the grooves 56 in the guides 14. The guides 14 have vertical extensions **14*a* protruding above the frame 12 and the frame opening 28. The grooves 56 are formed completely independently of any surface of the frame 12, thereby eliminating any necessity for having vertical extensions on the frame comparable in height to the upper sections 14*a* of the guides 14.**

The side wedge assemblies **18*a* include bronze wedge members 84 mounted to raised segments on the gate flanges 80 by means of keys 86 on the undersides of the wedges received in vertical slots 88. The wedge members 84 are held in place by bolts 90 and locking screws 92. The wedge members 84 have inclined surfaces 94 adapted to cooperate with the oppositely inclined bronze strips 62 on the wedge seats 58.**

Bottom and top wedge members 96, 98 are also mounted on the bottom and top ribs **76*b*, 76*c* respectively of the gate disc by means of mounting bolts 90 and locking screws 92. The wedge members 96, 98 have inclined surfaces 100 which cooperate in wedged engagement with oppositely inclined surfaces on bronze wedge seats 102 bolted to appropriately spaced bosses 104 on the bottom and top frame flange sections 22, 24 respectively of the frame 12.**

The gate disc 16 is raised and lowered by conventional means (not shown) connected thereto by an operating stem 106. The gate disc is movable vertically between a raised open position located between the upper sections **14*a* and the gate disc guides 14, and a lowered closed position overlying the frame opening 28. As the gate disc arrives at the closed position, the wedge members 84, 96 and 98 cooperate with their associated seats to force the gate disc 16 against frame 12, thereby bringing bronze seat facings 108 on the gate disc into tight sealing engagement with the opposed seat facings 36** on the frame.

The above-described sluice gate assembly provides a number of advantages not available with those heretofore available. For example, the frame 12 has a single-flange design which minimizes the amount of casting metal required. This saving is achieved without sacrificing strength and rigidity due in part to the following: (a) the provision of heavy rugged bosses 38 which underlie and support the base flanges 50 of the gate disc guides 14; (b) the alignment of the opposed bronze seat facings 36, 108 on the frame 12 and gate disc 16 respectively with the frame flanges 30, thereby making maximum use of the strength of said flanges, and thus minimizing any tendency of the frame flanges to distort or "roll over" when hydrostatic forces are exerted on the gate disc. The same bosses 38 which support the base flanges 50 of the disc guides 14 also provide lateral support for the frame flanges 52.

By employing a frame which is basically L-shaped in cross-section, casting procedures are considerably simplified, as compared with those employed in connection with the casting of conventional double-flange frames having C-shaped cross-sections. A C-shaped cross-section requires a central mold core which is not required when casting an L-shaped cross-section. Also, when casting a C-shaped cross-section, flanges must be tapered with nonparallel surfaces. This is due to the fact that such tapers are required on the mold patterns in order to accommodate their removal from the molds prior to casting. However, when casting L-shaped cross-sections, flanges need not be tapered and their surfaces can be made parallel. This greatly facilitates subsequent machining procedures, particularly the spot facing of bores. The gate assembly is capable of being mounted to a wall thimble or other like mounting surface, regardless of whether or not side clearance is available. Finally, the entire guiding action for vertical gate movement is provided by grooves in the gate disc guides, the said grooves being completely independent of the frame. This feature enables the uppermost movement of the gate to be accommodated by upper extensions of the gate disc guides alone, without comparable extensions on the frame.

It is my intention to cover all changes and modifications of the preferred embodiment herein described which do not depart from the spirit and scope of the invention as claimed.

I claim:

1. A sluice gate assembly comprising in combination: an integrally cast frame surrounding an opening and having a generally L-shaped cross-section defined by coplanar side, bottom and top flange sections with inner side, bottom and top walls protruding from the inner edges thereof, the inner side walls on said side flange sections extending along opposite sides of said opening, with a plurality of spaced bosses on said frame at the juncture between said inner side walls and said side flange sections; a pair of elongated guide members having base and guide flanges, said base flanges being secured to the upper surfaces of said bosses, said guide flanges having guide grooves formed exclusively thereon and extending along opposite sides of said opening and above said opening along upper sections of said guide members which upper sections protrude above said frame; a gate disc having side edges received in sliding engagement in said guide grooves, said gate disc being movable between an open position in part at least above said opening and closed position lying across said opening; and, wedge members on said gate disc cooperating with seat members on said frame and said guide members for wedging said gate disc into sealing engagement with said frame when said gate disc is in said closed position.

2. The apparatus as claimed in claim 1 further characterized by aligned openings in said side flange sections and said base flanges, said openings being adapted to axially receive mounting studs employed to mount the sluice gate assembly in an operative position.

3. The apparatus as claimed in claim 2 wherein the upper edges of said inner walls are coplanar with the upper surfaces of said bosses.

4. The apparatus as claimed in claim 1 wherein said guide members having lower sections adapted to be secured to the upper surfaces of said bosses, and upper sections which extend vertically above said frame.

5. A sluice gate assembly comprising in combination: a single flange cast frame having laterally spaced parallel vertically extending side flange sections joined by vertically spaced horizontally extending top and bottom flange sections, said flange sections being arranged in a common plane to define an opening and being adapted to be secured to a mounting surface, longitudinal inner walls protruding from said side flange sections, said inner walls extending along the sides of said opening, a plurality of bosses integral with and spaced vertically along the junction between said side flange sections and said inner walls, said bosses having upper planar surfaces lying in a plane common to that of the upper edges of said inner walls and parallel to the plane containing said flange sections; a pair of elongated gate disc guides having upper and lower sections, said lower sections being adapted to be mounted on said frame at locations overlying said side flange sections, with said upper sections protruding vertically above said frame, each said gate guides having a substantially L-shaped cross-section formed by a base flange and a guide flange, the lower sections of said base flanges being adapted to be removably mounted on the planar surfaces of said bosses, said guide flanges having guide grooves formed exclusively thereon and extending longitudinally over both said upper and lower sections; a gate disc having side edges adapted to be received in sliding engagement in said guide grooves, said gate disc being movable between a raised open position located at least in part between the upper sections of said gate guides and a lowered closed position between the lower sections of said gate guides; and, wedge members on said gate disc cooperating with seat members on said frame and said gate disc guides for wedging said gate disc against said frame when said gate disc is in the lowered closed position.

* * * * *